United States Patent [19]

Griggs

[11] 4,435,617

[45] Mar. 6, 1984

[54] SPEECH-CONTROLLED PHONETIC TYPEWRITER OR DISPLAY DEVICE USING TWO-TIER APPROACH

[76] Inventor: David T. Griggs, 5128 S. Rolling Rd., Baltimore, Md. 21227

[21] Appl. No.: 292,717

[22] Filed: Aug. 13, 1981

[51] Int. Cl.[3] ..... G10L 1/00

[52] U.S. Cl. ..... 381/44; 381/43

[58] Field of Search ..... 179/1 SA, 1 SB, 1 SD, 179/1 SE; 364/513; 340/146.3 WD

[56] References Cited

U.S. PATENT DOCUMENTS

| | | | |
|---|---|---|---|
| 3,440,617 | 4/1969 | Lesti | 179/1 SA |
| 3,646,576 | 2/1972 | Griggs | 179/1 SA |
| 3,798,372 | 3/1974 | Griggs | 179/1 SA |
| 3,808,371 | 4/1974 | Griggs . | |
| 3,846,586 | 11/1974 | Griggs . | |
| 3,869,576 | 3/1975 | Griggs | 179/1 SA |
| 4,039,754 | 8/1977 | Lokerson | 179/1 SA |
| 4,060,694 | 11/1977 | Suzuki et al. | 179/1 SD |
| 4,156,868 | 5/1979 | Levinson | 179/1 SD |
| 4,181,821 | 1/1980 | Pirz et al. | 179/1 SD |

*Primary Examiner*—Emanuel S. Kemeny
*Attorney, Agent, or Firm*—Joseph G. Seeber

[57] ABSTRACT

A speech-controlled phonetic device utilizes a two-tier approach for converting an audio input into visual form. The device basically comprises: various components for identifying different phonemes, such as a sound separator, various sensors and transducers, a vowel scanner, a vowel transducer, and a diphthong transducer; an input synchronizer; a transcriber processor; and a printer or display device. The two-tier approach involves a first tier, wherein the identified speech sounds are broken down into syllabits (groupings of classes of sound), the spoken sequence of those syllabits is separated into possible words, and the grouping of the syllabits is indicated. The second tier involves the use of stored words with those respective groupings, but narrowed down to essential phonemes only. Thus, the second tier acts to eliminate, from such possible words, all except a specific word (the actually spoken word), which contains each of the detected phonemes in the proper sequence. Further features of the invention include a vowel identification circuit using both formant peak detection and envelope detection-comparison techniques, and the use of an input synchronizer to provide phoneme identifiers to the transcriber processor.

28 Claims, 15 Drawing Figures

32
170
174
FRIC.
f
s
θ
r
v
z
ð
ʒ
SAMPLER
A=6
DIGITAL ENCODER
32
36
34
38
33
37
35
39
F
171
175
NASALS
m
n
b
ℓ
B=7
DIG. ENC.
51
52
53
54
SILENCE
N
172
176
178
VOWELS
l
i
I
ɛ
ℓ
a
ʔ
ɹ
u
ʌ
r
ə
"I"
"A"
OI
ℓ
"O"
"U"
C=10
SAMPLER
DIGITAL ENCODER
22
01
02
03
04
05
06
08
07
09
21
00
12
11
15
13
14
16
25
24
28
29
23
27
26
V
179
181
00
.2 SEC DELAY
AUGMS.
V
54
AUGMENTS
N
173
177
STOPS
D
T
K
P/K
i
d
g
ʤ
h
D=3
SAMPLER
DIGITAL ENCODER
41
42
43
44
45
46
47
48
31
S
44
48
AUGMENTS
S
AUGMENTS
F
TO FIG. 6A.
180
FROM SOUND SEP. 12
UNVOICED FRIC. GATE
VOICED FRIC. GATE
STRESS

SPEECH-CONTROLLED PHONETIC TYPEWRITER OR DISPLAY DEVICE USING TWO-TIER APPROACH

BACKGROUND OF THE INVENTION

1. Field of the Invention

The present invention relates to a speech-controlled phonetic typewriter or display device using a two-tier approach, and more particularly to a method and apparatus, not speaker-dependent, by means of which a spoken input of connected American English words can be received and utilized to produce, in real time, a simultaneous printed output which is, to the maximum extent possible, in the form of conventionally spelled words.

2. Description of the Prior Art

In recent years, there have been various efforts to convert speech directly into print as it is being spoken. Such efforts have taken advantage of the development of high-speed computers with multiplexed program operations, but such efforts have required programming and availability of extensive computer facilities.

Most recent efforts by the present inventor have been directed to the detection and analysis of speech sounds instantaneously without a computer, the conversion of the sounds by means of comparators, timers, filters and switching circuits into a real-time electrical phonemic analog of that which is being said, and the use of a special-purpose digital computer component to process and match syllabic sequences of sounds in the language. Such a technique and arrangement have been disclosed in U.S. Pat. No. 3,646,576—Griggs, which discloses the use of a computer element reduced in size, which element is used not for phonetic detection, but simply as a means of providing an output which is as closely related as possible to conventional printing, such being obtained by means of a pre-stored vocabulary of 12,000 words.

Other prior art techniques have included that disclosed in the U.S. Pat. No. 3,808,371—Griggs, which discloses real-time mechanical detection of diphthongs for a speech-controlled phonetic typewriter. More specifically, the technique disclosed in the latter patent relates to an improvement by means of which diphthongs may be distinguished from other sounds, including simple, single-vowel sounds. The distinction or identification of diphthongs is obtained by means of transduced electrical signals, each of which represents a distinctive diphthong relevant for subsequent written transcription by machine.

A further prior art technique is disclosed in U.S. Pat. No. 3,846,586—Griggs, which discloses an improved single-oral-input real-time analyzer with written printout. The improvement involves a first step of automatic and instantaneous conversion of speech into writing by separating the speech into various types of components (such as fricatives, vowels, plosives, nasals, etc.) by the use of only a single oral input. This is distinguished from the original development (disclosed in aforementioned U.S. Pat. No. 3,646,576), wherein two inputs were used, one from the throat and one oral. According to the technique of the aforementioned, U.S. Pat. No. 3,846,586, once the appropriate components of speech are separated, various switches, gates and other circuit mechanisms are used to actuate other circuitry, as well as a typewriter which records the input sounds.

The various techniques of the prior art, as exemplified by the aforementioned techniques, are burdened with various disadvantages. For example, various bandwidths and amplitude ratios cited in the previous patents are insufficiently precise for optimal real-time operation. The syllabic analysis provided in the tables of the above-discussed patents is inadequate and was based upon a premise that the syllables of the written language are in parallel relationship to the sonic building blocks of the spoken language. This proves not to be the case, as implied subsequently in this description.

SUMMARY OF THE INVENTION

The present invention relates to a speech-controlled phonetic typewriting or display device using a two-tier approach, and more particularly to a method and apparatus, not speaker-dependent, for speech-controlled phonetic typewriting or display, wherein a spoken input of connected American English words can be received and utilized to produce, in real time, a simultaneous printed output which is, to the largest extent possible, made up of conventionally spelled words.

The basic speech-controlled phonetic device of the present invention comprises: a system for identifying phonemes present in speech inputs, the preferred embodiment employing a sound separator, plosive sensor, stop transducer, fricative transducer, nasal transducer, a vowel identification section (including a vowel scanner and a vowel transducer), and a diphthong transducer; an input synchronizer; a transcriber processor; and a printer or display unit.

Although the present invention does not perfect mechanical recognition of spoken words by recognition of speech elements on a one-for-one basis, the invention does seek to match sets of speech sounds sequence-by-sequence with a stored vocabulary having a recommended minimum of about 12,000 words. In addition, the present invention calls for the isolated syllables and speech units which are not matched, to be printed out or displayed.

The apparatus of the present invention is intended as a dictational device, operating at dictational speed. It has been designed with the following objectives in mind: (1) it must accept both female and male voices without preliminary adjustments to each particular speaker's voice; (2) the output must be readily readable at virtually normal reading speeds without prior training; (3) the output should be instantaneous; (4) words are separated by linguistic programing of a computer component (the transcriber processor) in accordance with a two-tier method; and (5) the apparatus should reflect the characteristics of the input which it receives, so that the user will find it responsive, even if the output transcription reflects dialectal variations instead of standard spelling.

Further features of the invention include a vowel identification circuit using both formant peak detection and envelope detection-comparison techniques, and the use of an input synchronizer to provide phoneme identifiers to the transcriber processor.

Therefore, it is a primary object of the present invention to provide a speech-controlled phonetic device utilizing a two-tier approach to identify word entities.

It is an additional object of the present invention to provide a speech-controlled phonetic device which receives a spoken input of connected American English words, and produces, in real time, a simultaneous printed or displayed output which is, to the greatest extent possible, made up of conventionally spelled words.

It is an additional object of the present invention to provide a speech-controlled phonetic device which operates in real time.

It is an additional object of the present invention to provide a speech-controlled phonetic device which will accept most normal voices without pretuning to precise characteristics of a particular speaker's voice (as, for example, by a preliminary sampling process).

It is an additional object of the present invention to provide a speech-controlled phonetic device which will handle connected or running speech suitably so as to obtain a readable printed or displayed first draft.

It is an additional object of the present invention to provide a speech-controlled phonetic device having a vowel identification circuit using both formant peak detection and envelope detection-comparison techniques.

It is an additional object of the present invention to provide a speech-controlled phonetic device which uses an input synchronizer to provide phoneme identifiers to the transcriber processor of the device.

With the above and other objects in mind, the invention will now be described in more detail with reference to various figures of the drawings.

DETAILED DESCRIPTION

The invention will now be described in more detail, with reference to FIG. 1 which is a block diagram of the speech-controlled phonetic device utilizing a two-tier approach in accordance with the present invention. The two-tier approach to phonemes is directed to detection of the presence of each phoneme in two distinct processes which coalesce to establish the identity of each phoneme.

Figure 1:
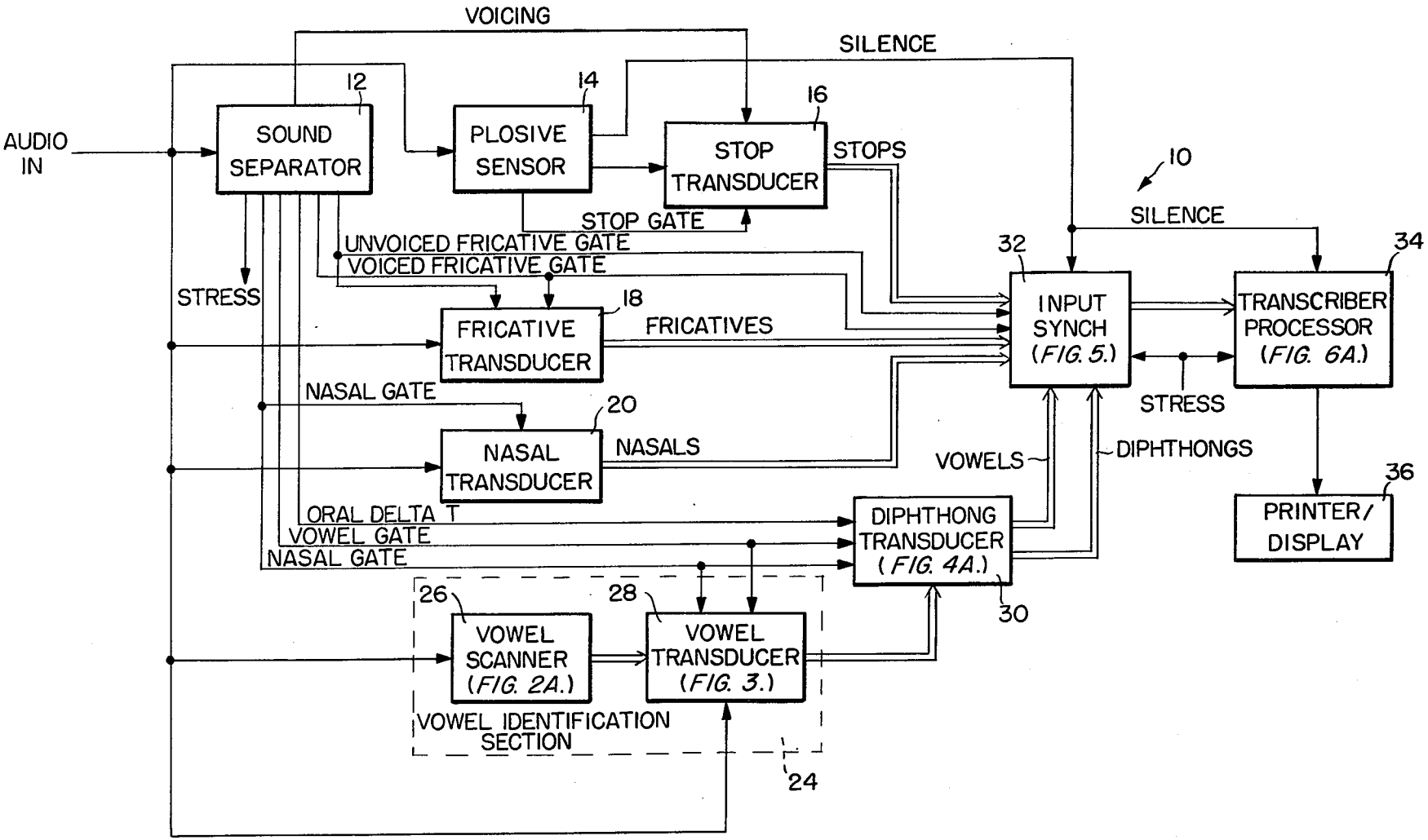
FIG. 1 is a block diagram of the speech-controlled phonetic device of the present invention.

As seen in FIG. 1, the speech-controlled phonetic device 10 basically comprises a sound separator 12, plosive sensor 14, stop transducer 16, fricative transducer 18, nasal transducer 20, vowel identification section 24 (including vowel scanner 26 and vowel transducer 28), diphthong transducer 30, input synchronizer 32, transcriber processor 34 and printer or display 36.

Prior to a detailed description of the operation of the speech-controlled phonetic device 10 of FIG. 1, some background information is appropriate. A basic design for a speech-controlled phonetic typewriter consists of transducers, a transcriber, and a print-out device such as a high-speed electric typewriter. The transducers convert speech elements into electrical signals, while the transcriber processes those signals according to linguistic analysis (pre-prgrammed into the transcriber), divides the material into words and syllables which are not parts of words stored and identified, and supplies specified punctuation. Linguistic analysis is, in accordance with the present invention, based upon a set of 377 syllabits, that is, 377 sequences which define all the possible sequences of phonemes which characterize English speech (that is, all possible sequences of the four classes—nasals, stops, vowels and fricatives—of sound for English speech).

In detecting speech sounds in accordance with the present invention, there are certain important operational limitations, such as exclusion of ambient noise accompanying the oral input, clear and moderate-speed verbal input, and inability to handle proper names unless pre-stored. Of course, the stored vocabulary can be altered from unit to unit, or from time to time, in order to accommodate different speech traits and different vocabulary requirements.

Referring to FIG. 1, in operation, the audio input or vocal input to the speech-controlled phonetic device 10 is first sorted according to four basic types of speech sounds: (1) plosives, that is, stops either terminal or followed by releases; (2) fricatives, that is, steady or even sounds caused by the stricture of the breath; (3) occasional weak vowels and nasals; and (4) vowels. This sorting can be done by various timers and filters, as is well known to those of skill in the art, such timers and filters being focused on certain bandwidths of the speech spectrum. Timers are particularly helpful in separating diphthongs from vowels. As seen in FIG. 1, the audio input passes, in parallel, through various networks of filters and/or timers corresponding to the particular kind of sound to be detected, and the network distinguishes the particular kind of sound to be detected from the other sounds contained within the audio input.

The first type, the plosive, is distinguished as a sudden break in the level of speech sounds; it is a momentary disruption in the stream of sound. An abrupt burst or release usually follows, and those bursts are differentiated according to the frequencies and energy distributions which are characteristic for sounds corresponding to the letters p, t and k, or, with voicing, b, d and g.

The second type, the fricative, is identified by an even distribution of energy within the bandwidth at different frequencies, and by whether or not there is voicing added.

With these first two types, the presence or absence of voicing is detected as one function of the sound separator 12.

The third type, a nasal sound such as produced by the letters m, n and ng, has a concentration of energy, or its absence, in certain portions of the frequency spectrum, which can be detected by appropriate bandwidth filters. The "el" sound is identified, together with the nasals, in a similar manner. Certain occasional weak vowels are detected as well.

The fourth type, the vowel (and the diphthong), is detected in a manner which will be described in more detail below, in connection with a detailed description of the present invention.

In the speech-controlled phonetic device 10 of FIG. 1, the audio is provided to a sound separator 12, which is a conventional circuit, such as disclosed in FIG. 2 of U.S. Pat. No. 3,646,576. The sound separator 12 detects voicing or its absence, and separates the occurrence of any vowel, nasal or fricative sound. The audio input is also provided to the plosive sensor 14, which is also a conventional circuit, such as disclosed in FIG. 3 of U.S. Pat. No. 3,646,576. The plosive sensor 14 distinguishes stops from silences, and conveys silence indications to the input synchronizer 32 and transcriber processor 34. The output of the plosive sensor 14 is also provided to a stop transducer 16 which is also a conventional device, as disclosed in FIGS. 4 and 4A of the aforementioned U.S. patent. The output of the stop transducer 16 is provided to input synchronizer 32, and comprises an electrical signal corresponding to the occurrence of a stop in the audio input.

Figure 5:
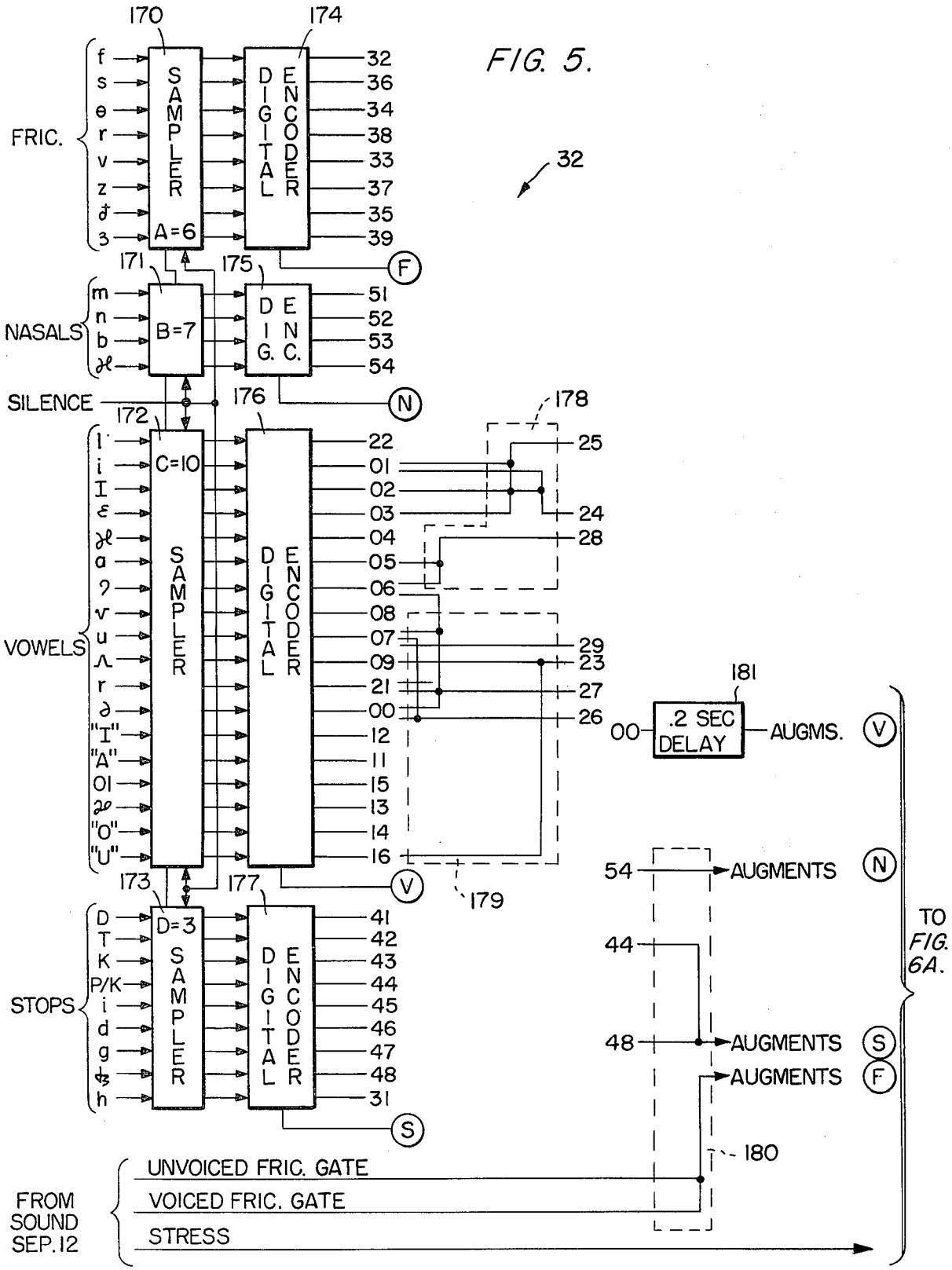
FIG. 5 is a detailed diagram of the input synchronizer of FIG. 1.

The fricative transducer 18 is a conventional circuit, as disclosed in FIG. 5 of the aforementioned '576 patent, and provides an electrical signal separately identifying each fricative in the audio input.

Nasal transducer 20 is a conventional circuit, as disclosed in FIG. 6 of the '576 patent, and provides an electrical signal separably identifying each nasal sound in the audio input.

The audio input to the typewriter 10 is also provided to the vowel identification section 24, and specifically to a vowel scanner 26 included therein. The scanner 26 comprises both preliminary comparators and formant peak detectors which detect the high energy points of the first and second formants of a vowel. In the latter regard, vowels are known to have three or four formants, the first two of which are quite important in the speech distinction procedure of the present invention. Whereas the vowel scanner 26 will be described in more detail below, with reference to FIG. 2A, it should be noted at this point that the formant-peak detectors in the vowel scanner 26 indicate the point in the frequency spectrum where the highest and next highest peaks lie.

Figure 3:
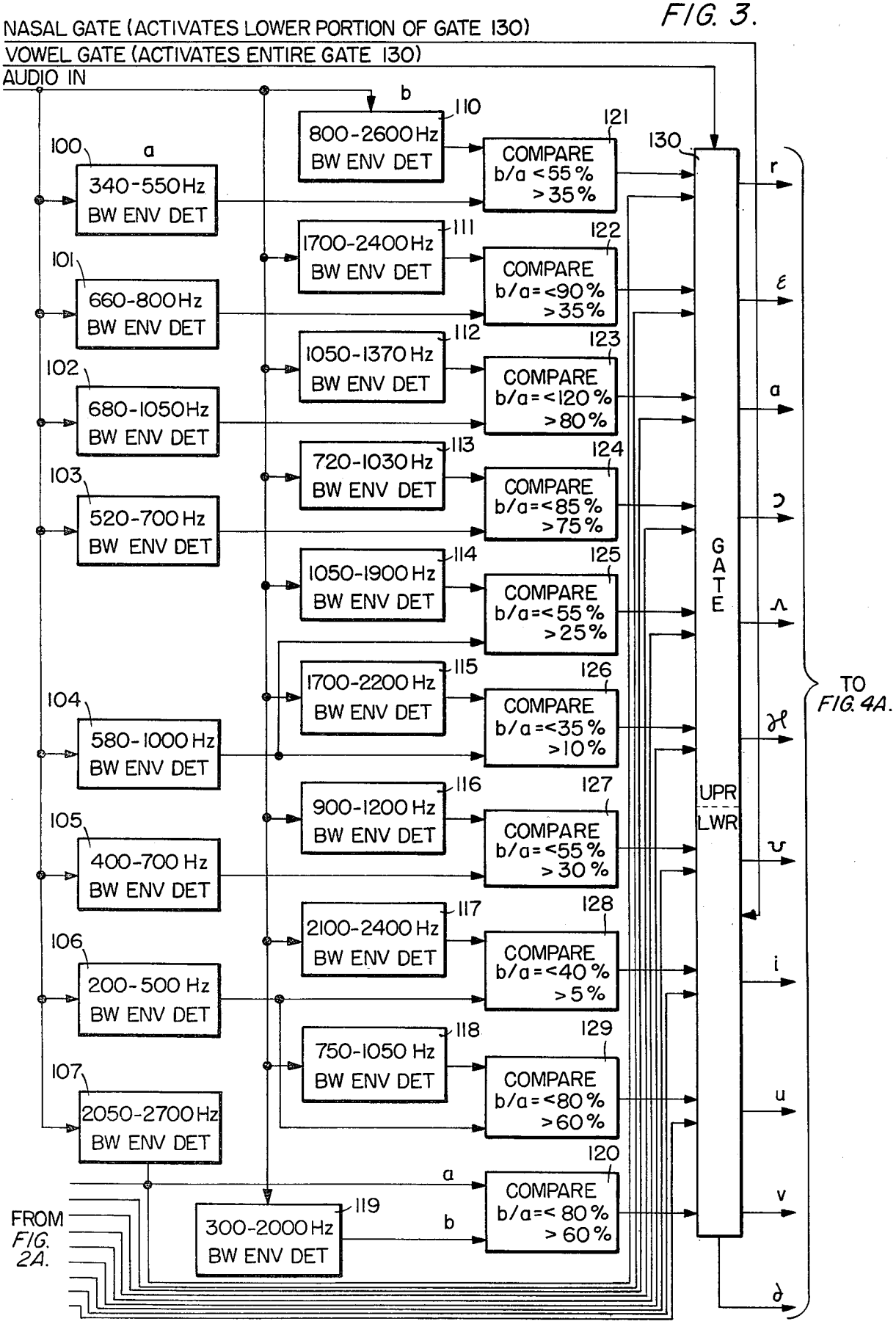
FIG. 3 is a detailed diagram of the vowel transducer of FIG. 1.

The output of the vowel scanner 26 is provided to vowel transducer 28 which, in a manner to be described in more detail below with reference to FIG. 3, provides an electrical signal characteristic of the occurrence of whatever vowel occurs in the audio input. Diphthong transducer 30 receives the output signal of vowel transducer 28, and provides an electrical output signal corresponding to the occurrence of a diphthong (that is, a double vowel with a shift in frequency in the middle) to the input synchronizer 32, which also receives the respective outputs of the stop transducer 16, the fricative transducer 18 and the nasal transducer 20.

Input synchronizer 32 operates in a manner to be described in more detail below, with reference to FIG. 5, to provide a synchronized output to the transcriber processor 34. The output of input synchronizer 32 comprises a series of indications of the identification of the various identified sounds within the audio input. Once these various speech sounds have been thus identified by the circuitry to the left of input synchronizer 32 (in FIG. 1), the corresponding indication of the type of sound is provided to the transcriber processor 34, wherein (as will be seen in more detail below, with reference to FIG. 5A) it is temporarily stored. Those sounds not appearing to fit into recognizable words during the operation of the transcriber processor 34 will be printed out or displayed phonetically as a result of this temporary storage.

The transcriber processor 34, as explained in more detail below (with reference to FIG. 6A), performs the function of identification of words and syllables. That is to say, transcriber processor 34 receives each speech-sound identity, and identifies actual combinations (patterns) of the sounds that occur in the language, of which there are approximately 377. When such a pattern has been recognized, a syllabit is, in accordance with the present invention, identified for further processing. Conversely, if a sound does not fit, it tentatively becomes the beginning of a possible new pattern. Regrouping of a tentatively preexisting syllabit by using each sound as the start of a different pattern is also tried, in transcriber processor 34, before a sound is treated as an isolated one. The matching and grouping processes take place in transcriber processor 34 at a very rapid rate, through the use of electrical circuitry in the computing unit. Separation between words and syllables results, separations also following from breaks in the stream of speech, such as occur at the end of phrases or sentences, as conveyed from the plosive sensor 14.

Transcriber processor 34 stores a minimum of some 1,600 short words having less than four speech sounds in them, and a minimum of about 10,500 longer words, in the preferred embodiment. However, it should be recognized that transcriber processor 34 could store a greater or lesser number of words, depending on particular applications to which the typewriter or display is to be put, or particular parametric requirements for the operation of the typewriter or display. Words are stored within the transcriber processor 34 according to constituent speech sounds, and with a coding for correct spelling to facilitate print-out. The words are also filed according to the syllabits (patterns) that appear in them. Within each pattern, and for each word, there is a distinct sequence of sounds which must occur in order to activate a spelling code within transcriber processor 34. In the matching process conducted therein, the longest possible forms of words which start the same are given first priority. Longer words are tried before shorter ones in the preferred technique. As words are identified, the stored conventional spelling for each word is obtained, and spacing is provided for printing out the word. Any material between the identified words is released in its proper sequence, and either isolated or separated into syllables which are phonetically printed so that nothing is lost. Since the names of the letters of the alphabet and numbers will produce appropriate printed symbols, items can be spelled orally by using the audio input to the typewriter 10 of FIG. 1. In addition, punctuation can be dictated. The recommended stored vocabulary of about 12,000 words comprises the most commonly used words in the language, but the printed or displayed output is not limited to these words. In fact, the stored vocabulary comprises a set of words which, once identified, will be spelled in a conventional and correct manner. Words not included within the stored vocabulary will be spelled inaccurately or spelled phonetically, and can be identified by a user when reviewing the printed draft or the display.

It should be recognized that, for different models of speech-controlled phonetic devices, different vocabularies can be stored, if desired. It should also be recognized that, if desired, words pronounced in a variable manner are pre-stored or coded in more than one form, so that more than one form of the word will be recognized, with the word still being printed out or displayed uniformly. This feature of the present invention is subject to adjustment, if desired, in order to further accommodate regional or individual speech peculiarities.

Referring once again to FIG. 1, it is to be noted that sound separator 12 provides outputs to the various other elements of the speech-controlled phonetic device 10 of FIG. 1, specifically to the stop transducer 16, the fricative transducer 18, the nasal transducer 20, the vowel transducer 28, the diphthong transducer 30, and the input synchronizer 32. These output signals are derived by the sound separator 12 in the manner discussed in aforementioned U.S. Pat. No. 3,646,576, with reference to FIG. 2 thereof, which discloses the sound separator 12. Thus, sound separator 12 and the plosive sensor 14 together class the audio input into one of six categories: unvoiced stops, voiced stops, unvoiced fricatives, voiced fricatives, nasals and vowels (including diphthongs or double vowels).

Figure 2A:
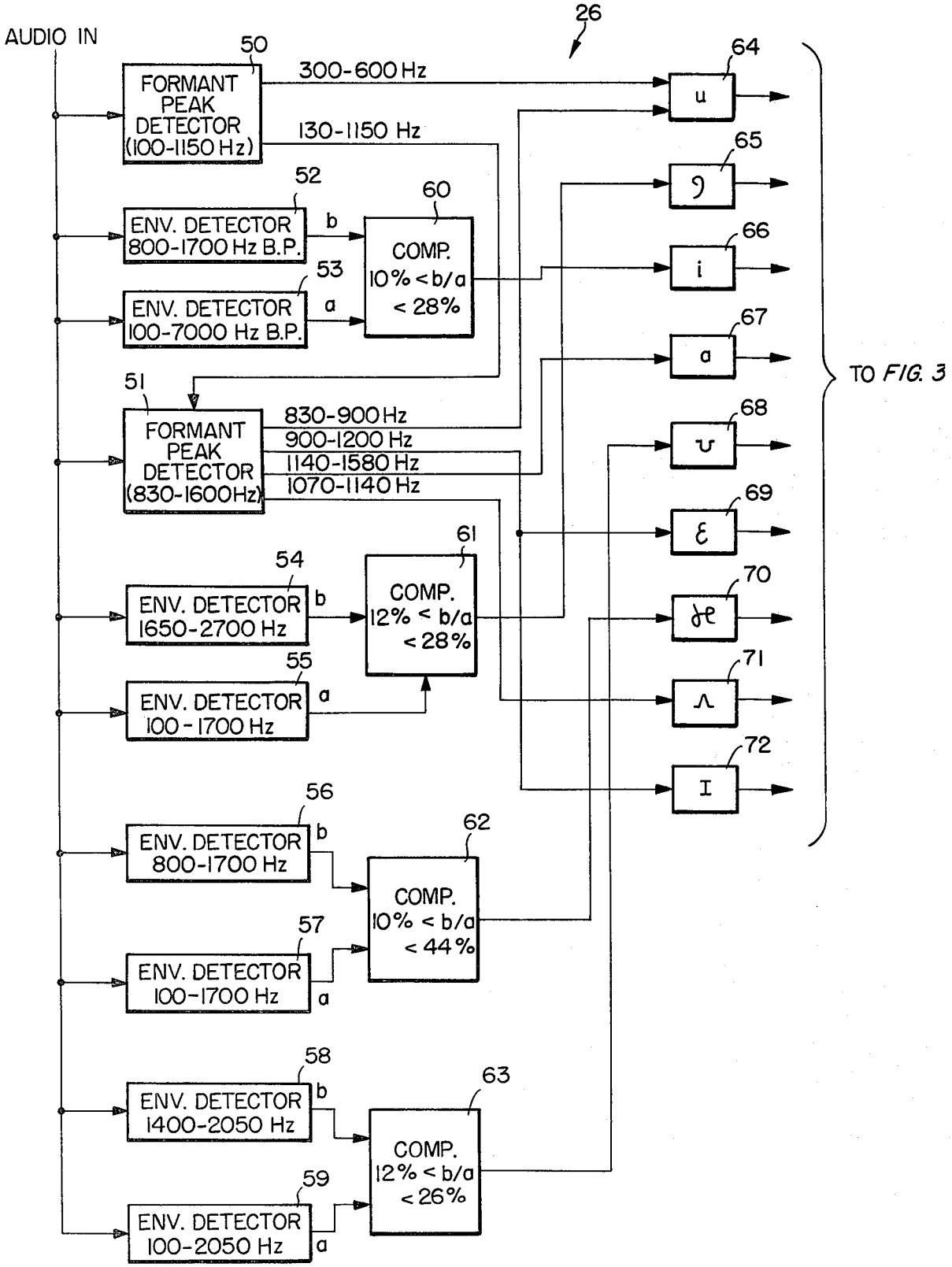
FIG. 2A is a detailed diagram of the vowel scanner of FIG. 1.
Figure 2B:
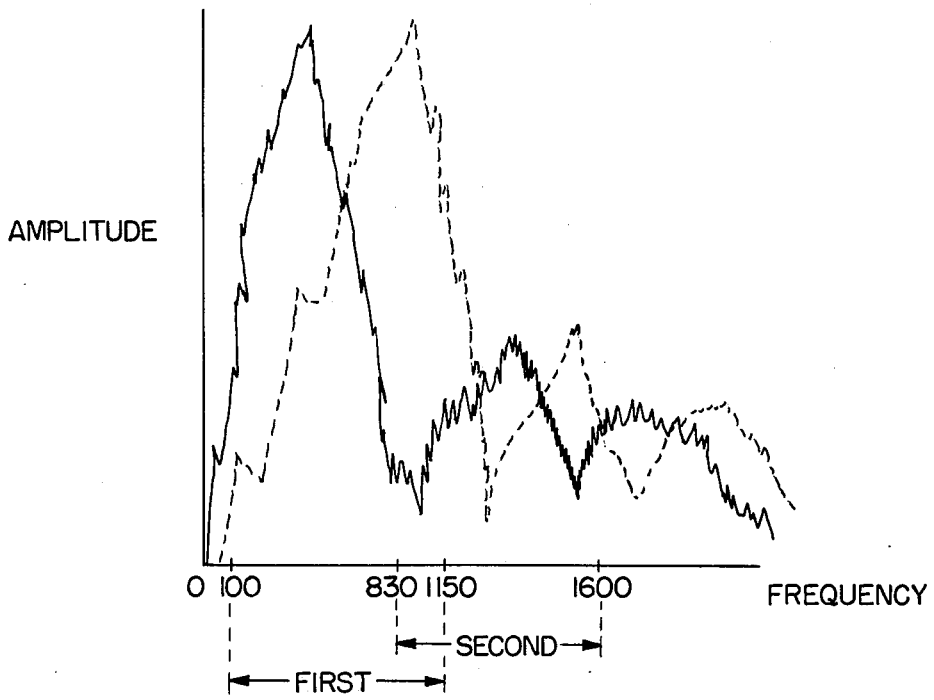
FIG. 2B is a graphical illustration of first and second formants contained within a typical audio input.

FIG. 2A is a detailed diagram of the vowel scanner 26 of FIG. 1, the operation of which will now be explained with reference to FIG. 2B, which is a graphical illustration of first and second formants within an audio input. As seen in FIG. 2A, the formant-peak scanner includes peak scanners 50 and 51, envelope detectors 52–59, comparators 60–63, and gates 64–72.

In operation, the vowel scanner 26 of FIG. 2A makes extensive use of the energy within the audio input, and employs at least one criterion to identify each separate vowel. Energies for various bandwidths of the audio input are compared to identify vowels occurring in the audio input. Thus, the vowel scanner 26, by using the audio input and processing it by means of various peak detectors, bandwidth envelope detectors and comparators, distinguishes nine simple vowel sounds, one from the other, as a preliminary step toward the distinctive identification (through a gating procedure shown in FIG. 3, and described below).

Continuing with FIG. 2A, the audio input is provided to envelope detectors 52–59, each focusing on a given bandwidth (as indicated in the various blocks 52–59 of FIG. 2A). The outputs of comparators 52 and 53 are provided to comparator 60, the outputs of detectors 54 and 55 are provided to comparator 61, the outputs of detectors 56 and 57 are provided to comparator 62, and the outputs of detectors 58 and 59 are provided to comparator 63. If the ratios (b/a) shown by the comparators 60–63 lie within the ranges specified in blocks 60–63, the four vowel signs, indicated in gate blocks 66, 67, 70 and 68, respectively, are tentatively identified. Indication signals are prepared for further processing in FIG. 3.

The audio input is also supplied to peak detectors 50 and 51, peak detector 50 receiving and processing that portion of the audio input in the bandwidth 100–1150 Hz., while peak scanner 51 processes that portion of the audio input in the bandwidth 830–1600 Hz. The peak detectors 50 and 51 search for the highest amplitude peak to be found in a width of 20 Hz. somewhere within that spectrum, and, for the next highest such peak, with respect to their locations within the spectrum bandwidths. Referring to FIG. 2B, such peaks in the first and second bandwidth ranges (100–1150 and 830–1600 Hz., respectively) are shown.

The detection performed by peak detectors 50 and 51 determines whether those peaks lie within one or more of the six ranges: 300–600, 130–1150, 830–900, 900–1200, 1140–1580 and 1070–1140 Hz. It is also determined whether, in each instance, it is the highest or next highest peak. These respective determinations activate signals, shown at the output of gates 64–72, for tentative identification of the vowel phonemes indicated. These various identification signals are passed to the vowel transducer 28 (FIG. 3) for further processing.

It is to be noted that, in the range of 830–1150 Hz., there is an overlap of scanning, such that the question of whether the peak is the highest or second-highest peak of the spectrum of the envelope must be determined, and a consequent correlation must be made as between the upper four ranges (830–900, 900–1200, 1140–1580 and 1070–1140 Hz.) and the lower range (100–1150 Hz.). This is due to the fact that the peak that lies in the upper ranges must be that of the second formant only; the first formant must be present in the lowest range simultaneously. Referring to FIG. 2B, the latter is indicated by dotted lines, which indicate how the first formant peak can shift to the right, thus appearing at a higher range where it must not be misconstrued as the second formant peak.

FIG. 3 is a detailed diagram of the vowel transducer 28 of FIG. 1. As seen therein, the vowel transducer 28 comprises envelope detectors 100–107 and 110–119, as well as comparators 120–129 and gate 130.

In operation, envelope detectors 100–107 and 110–118 receive the audio input, and perform a conventional envelope detection procedure in accordance with various specified bandwidths. The detectors 100–107 produce envelope detection outputs which are provided, as shown, to comparators 120–129, respectively. Each of comparators 120–129 performs the comparison operation indicated in each respective block (in FIG. 3) to determine whether or not the ratio (b/a) of the inputs to each comparator falls within a specified range (e.g., 35–55% in comparator 121). If a positive comparison occurs, a corresponding comparison output is sent to gate 130. Gate 130 receives the control inputs NASALS and VOWELS (provided by sound separator 12 of FIG. 1), as well as the particular vowel-identifying inputs from the vowel scanner 26 of FIG. 2A. Gate 130 is responsive thereto for selectively providing one, and only one, of the inputs received from the vowel scanner 26 of FIG. 2A, as an output, to the diphthong transducer 30 (FIG. 1).

More specifically, in the vowel transducer 28, the envelope detectors 100–107 and 110–118 provide outputs representative of the energy within the envelope of the received audio input signal for a given bandwidth (as specified within the particular envelope detection block of FIG. 3). The comparators 120–129 compare the respective energies provided thereto, and a given comparator provides a signal only if the energies are within a certain percentage range of each other. If a positive comparison occurs, a corresponding comparator output signal is provided to the gate 130. This comparator output signal acts as an enabling signal to enable transmission, through gate 130, of a corresponding vowel-identifying input from the vowel scanner 26 of FIG. 2A.

To summarize, the operations shown in FIG. 2A provide tentative identifications for nine sample vowel sounds, but are susceptible to overlap in indentifications and are not always mutually exclusive. Accordingly, the results of the operation of the vowel scanner 26 of FIG. 2A require further refinement. That refinement takes place in the form of confirmation or gating, for each individual sound, as shown in the vowel transducer 28 of FIG. 3. The vowel transducer 28 of FIG. 3 narrows the possibilities to a single possibility, thereby clearly identifying the particular vowel contained in the audio input. That particular vowel is identified by a single output signal provided by the gate 130 of the vowel transducer 28.

Figure 4B:
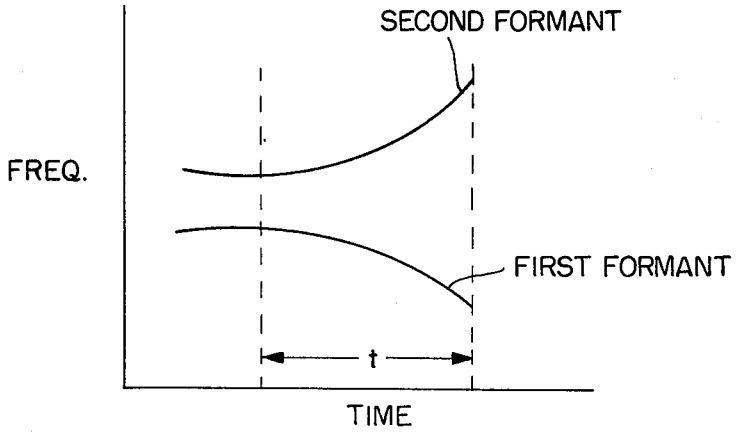
FIG. 4B is a diagrammatic illustration of a diphthong, and is utilized to describe the operation of the diphthong transducer of FIG. 1.
Figure 4A:
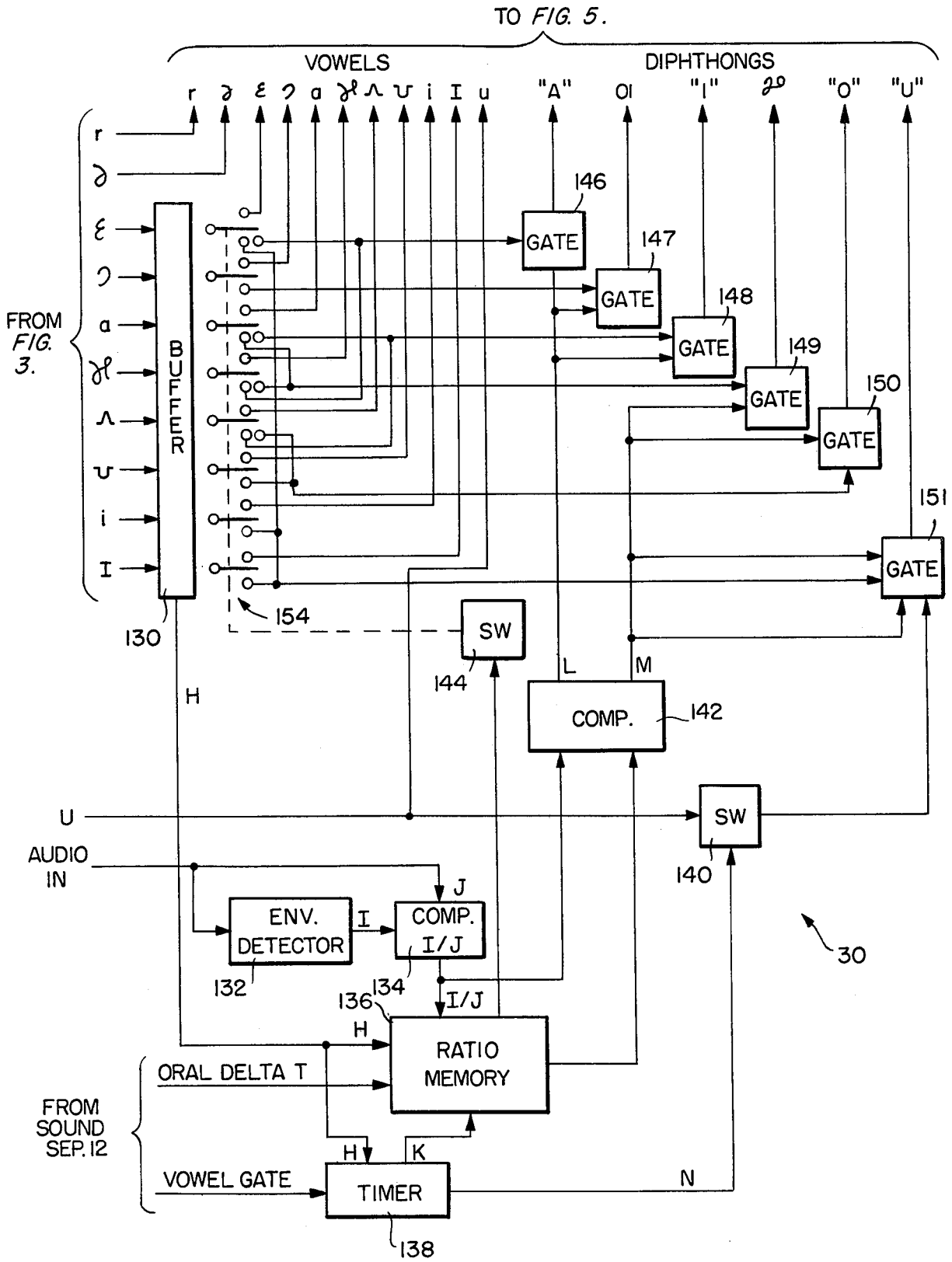
FIG. 4A is a detailed diagram of the diphthong transducer of FIG. 1.

FIG. 4A is a detailed diagram of diphthong transducer 30 of FIG. 1. As seen therein, the diphthong transducer 30 comprises a buffer 130, envelope detector 132, comparator 134, ratio memory 136, timer 138, switch 140, comparator 142, switch 144, and gates 146–151. A network of connections in the diphthong transducer 30 makes provision to detect certain dialectal versions of the diphthong.

The diphthong transducer 30 processes single-vowel outputs from the vowel transducer 28 of FIG. 3 to identify diphthongs, when present. More specifically, the diphthong transducer 30 produces an electrical output signal at the output of a respective one of the gates 146–151 upon detection of a corresponding one of six diphthongs. Since the transducer 30 also relays the eight single-vowel signals (provided as an input to the buffer 130), the transducer 30 passes all vowel and diphthong output signals detected by the diphthong transducer 30 to the input synchronizer 32 (FIG. 5).

The buffer 130 receives an output from the vowel transducer 28 (FIG. 3) via one of the inputs to the buffer 130, the buffer 130 holding the input for a predetermined time period (preferably 0.2 seconds). The single-vowel signals provided to the buffer 130 represent the basic simple vowel phonemes of American English as continuous signals, timed (as just mentioned previously) to last 0.2 seconds each, except for /u/ which is transmitted directly to the output /u/ of transducer 30 in single, somewhat shorter, pulses. The continuous signals allow retention of the single-vowel signals, prior to their release, for that period of time required to determine whether or not they are used in a diphthong. Since /u/ occurs only terminally, such delay is not required for it. Reception by buffer 130 of any one of the eight vowel identification inputs (/u/ is excluded) causes generation of output H which is provided to the ratio memory 136 and to the timer 138.

The diphthong transducer 30 of FIG. 4A also receives the audio input (AUDIO IN), which is provided to both envelope detector 132 and comparator 134. Envelope detector 132 performs envelope detection in the range of the bandwidth of the second formant (1050–2880 Hz.), and provides the envelope detector output I to one input of the comparator 134, the other input of which receives the audio input J (AUDIO IN). Comparator 134 performs a ratio operation with respect to inputs I and J, and provides the present ratio I/J to both the ratio memory 136 and the comparator 142. Ratio memory 136 also receives, from sound separator 12 (FIG. 1), the input ORAL DELTA T, a signal which reflects the rate of change in the oral input, and which has less than a five percent average change per 0.01 second interval.

The timer 138 is enabled and commences timing as a result of reception of VOWEL GATE. The timer continues to perform its timing operation for at least 0.01 seconds after the identification of a vowel. Identification of a vowel is indicated to the timer 138 by generation, by buffer 130, of the output H, the latter occurring whenever a vowel is identified.

Once the timer 138 has completed its operation (0.1 seconds after the identification of a vowel), the output K is provided to the ratio memory 136, and this causes the ratio memory 136 to release the ratio which it has been holding since the initial identification of the input phoneme, as indicated by the output H of buffer 130 which is applied to the ratio memory 136 (as well as to the timer 138, as previously explained). It should be noted that the output H of buffer 130 appears in response to identification of any of the eight vowels indicated at the intput of buffer 130, and this excludes /r/, /u/, and /ə/.

To further explain the operation of the diphthong transducer 30 (FIG. 4A), the ratio released by ratio memory 136 is provided to one input of comparator 142, the other input of which receives an output I/J from comparator 134. Comparator 134 is, as previously described, connected to the output of an envelope detector 132, the input of which receives AUDIO IN. That is to say, the ratio is compared from the beginning of the vowel to the end of the diphthong, when one is present, as determined by the AUDIO IN input applied to the envelope detector 132. The operations of the envelope detector 132 and comparator 134 have been described above, and result in the generation of output I/J provided to both the ratio memory 136 and the comparator 142. The output I/J is provided, as a present ratio input, to the comparator 142, and, once the other ratio is released from ratio memory 136, comparator 142 compares its two inputs to see what type of change has occurred.

However, prior to that comparison taking place, the rate of change of oral signal, as indicated by ORAL DELTA (provided to ratio memory 136), must be taken into account. In any event, the comparison operation of comparator 142 reflects either a rising tail or a falling tail, and this switches respective ones of the gates 146–151 to indicate detection of corresponding diphthongs. If there are no diphthongs present, the ORAL DELTA T input or the timer 138 will prevent operation of the comparator 142, and will also allow the simple vowel signals that are not involved with diphthongs to pass through the diphthong transducer 30 (via the buffer 130).

Referring to FIG. 4B, which is a diagrammatic illustration of one kind of diphthong as would occur in English language speech, it can be seen that the diphthong transducer 30 of FIG. 1 measures the change in frequency and amplitude during the execution of a diphthong, the change in frequency being illustrated in FIG. 4B. The diphthong transducer arrangement of FIG. 4A has been designed based on the realization, in accordance with the present invention, that the diphthong has a variation in frequency toward the end of the time interval t, as indicated in FIG. 4B. Terminal shifts of frequency such as these are accompanied by changes in amplitude in the speech envelope, as a whole. Such changes (in ORAL DELTA T) at the end of time t are the changes which ratio memory 136 and timer 138 compare, so as to give an indication of frequency change during the time when other characteristics of a diphthong are present. In this manner, the frequency shift need not be measured as to particular frequencies involved. It is simply the side-effect of the change that is detected. Based on this realization, simple vowels (which have no such variation) can be separated and distinguished from diphthongs. This function is carried out, in the diphthong transducer 30 of FIG. 1, by the ratio memory 136 and timer 138 of FIG. 4A. That is to say, if ORAL DELTA T (the input to ratio memory 136) changes, the presence of a diphthong is indicated, while, if there is no change, absence of a diphthong is indicated.

As previously explained, the output of ratio memory 136 is provided to comparator 142, the other input of which is the ratio input I/J of comparator 134. As generally indicated above, the comparator 142 distinguishes between diphthongs A, I and oi (on the one hand), which are indicated by a rising tail of the diphthong pattern (FIG. 4B), and diphthongs ao, O and U (on the other hand), indicated by a falling tail in the diphthong pattern (FIG. 4B). In the first case, the comparator 142 issues an output L which enables gates 146, 147 and 148, so as to pass through a corresponding input to the buffer 130. The second case is indicated by an output M from comparator 142, which output M is used to enable gates 149, 150 and 151, thus enabling a corresponding one of the inputs to the buffer 130 to be passed through. In this manner, gates 146–151 can provide respective outputs A, oi, I, ao, O and U, thus indicating a detected one of six diphthongs.

Of course, it is to be realized that the various inputs to buffer 130 will only be passed to the gates 146–151 if a respective one of the switches, generally indicated by reference 154, is actuated to the lowermost position. Actuation of switches 154 to the lowermost position is accomplished by switch circuit 144 in response to detection, by ratio memory 136, that a diphthong is present. As mentioned above, a diphthong is determined to be present if there is a change in the ORAL DELTA T input to ratio memory 136. If there is no change in the ORAL DELTA T input to ratio memory 136, ratio memory 136 determines that a diphthong is not present, and causes switch circuit 144 to actuate the switches 154 to the uppermost position. As a result, the vowel identification inputs from vowel transducer 28 (FIG. 3), as provided to buffer 130, are passed through the switches to the vowel outputs (as opposed to the diphthong outputs of gates 146–151).

As mentioned previously, a network of connections on the output side of switches 154 (to the right of switches 154 in FIG. 4A) makes provision for the detection of dialectal variations in certain diphthongs.

It has been discovered that some individuals speak in such a way that the diphthong "U" cannot be detected by comparator 142, that is, by means of the "falling tail" criterion described above. In order to detect the diphthong "U" for such speakers, the input "u" to diphthong transducer 30 is provided to a switch 140, and switch 140 passes the "u" input therethrough in synchronization with the timer 138, via the output N provided by timer 138 to the switch 140. The output of switch 140 is connected to the input of a gate 151, and the gate 151 has an enabling input connected to the output M of comparator 142, so that the /u/ will only be released by gate 151 and provided as output /U/ of the diphthong transducer 30 if a falling tail of the diphthong pattern (FIG. 4B) is detected by comparator 142.

To summarize, the diphthong transducer 30 of FIG. 1 (shown in detail in FIG. 4A) determines whether or not the vowel identification inputs from the vowel transducer 28 (FIG. 3) are truly indicative of vowels, or are indicative of diphthongs (double vowels). The diphthong transducer 30 provides an indication of the particular vowel or diphthong via its vowel or diphthong outputs, which are provided to the input synchronizer 32 (FIG. 1).

FIG. 5 is a detailed diagram of the input synchronizer 32 of FIG. 1. As seen therein, the input synchronizer 32 comprises samplers 170–173, digital encoders 174–177, combination networks 178, 179 and 180, and delay circuit 181.

The main purpose of input synchronizer 32 is to provide digital codes representing specifically detected phonemes. Thus, detected fricatives are provided to sampler 170, detected nasals are provided to sampler 171, detected vowels are provided to sampler 172, and detected stops are provided to sampler 173. These samplers 170–173 merely hold a particular phoneme-indicating input so that the subsequent digital encoder 174, 175, 176 or 177 can digitally encode the detected phoneme and provide a corresponding coded output. The samplers 172–173 provide an indication as to whether the current phoneme is F, N, V or S, and encode that information.

Each of the samplers 170–173 is reset upon detection of silence, via input SILENCE from sound separator 12 (FIG. 1). The duration of the first phoneme sets the samplers, in accordance with a ratio, for the duration of the second and subseqent phonemes, until the next silence occurs, at which time SILENCE resets each of the samplers 170–173. Thus, input synchronizer 32 regulates duration of the various digital phoneme signals in proportion to their real-time presence, so that, when they are repeated successively in speech, each intended repetition will register. For example, the words "reduce speed" are usually spoken with the intention that two "s" sounds be present. However, without regulation of the duration of the digital phoneme signals in the input synchronizer 32, one long "s" sound will merely be heard. Regulation of that duration depends upon the fact that there is a consistent ratio between the respective durations of nasals, vowels, fricatives and plosives in normal speech, and that ratio is employed here. If a particular speaker should speak slowly, the timing of his first sound will give the key to the relative expected duration of that speaker's timing not only for that particular type of speech sound when it recurs, but also for other types of speech sounds as well. Sudden changes, of course, can occur. But it is the junctures between words that are the issue with respect to the present invention. The invention is designed with the objective, in mind, that it must afford every opportunity to find the ends and beginnings of words. This is one way of ensuring that junctures between words are distinguished, especially since those junctures tend to blend together.

Therefore, referring to FIG. 5, and to samplers 170–173 disclosed therein, each sampler has a respective ratio value (A=6, B=7, C=10 and D=3, respectively), which ensures that samplers 170–173 correctly time the reception and holding of a given one of the phoneme identification inputs to the input synchronizer 32.

Input synchronizer 32, as shown in FIG. 5, also contains connection networks 178–180 and delay circuit 181. Connecting networks 178 and 179 receive various combinations of coded outputs from digital conversion circuit 176, and thus indicate particular phoneme entitles (23–29) which are combinations of various other phoneme entitles already identified by digital conversion circuit 176. These additional phoneme entitles (23–29) constitute groupings in which the presence of any one of the connected phonemes will produce a given result. For example, phoneme identification outputs 05 or 06 will activate phoneme identification output 28 (via combination network 178). This feature allows substitution of like sounds for each other at certain positions in words where they are the weak sounds, or where pronunciation habits are diverse. Combination networks 178 and 179 perform similar functions.

Combination network 180 includes various identification outputs to obtain further identification outputs pertaining to various augments (to be utilized in the transcriber processor 34) to be described in more detail below, with reference to FIG. 6A.

Finally, the delay circuit 181 determines a duration or delay of 0.2 seconds in the phoneme identification output 00. That delay is required to compensate for the 0.2 second delay that takes place in the diphthong transducer 30, wherein most vowels are subjected to that delay, pending possible inclusion in a diphthong identification.

The input synchronizer 32 of FIG. 5 produces identification outputs F, N, V and S corresponding to the presence of respective classes of sound (fricatives, nasals, vowels and stops). This is a categorization that accompanies or follows from identification of the phonemes (by samplers 170–173 and encodes 174–177) individually in their own right. In slow speech, and with careful enunciation, these outputs alone can serve to allow the two-tier analysis to proceed. However, if speech becomes more rapid or less clear, it will become more important to know the presence of certain types of sounds, even if their specific identities become somewhat obscure. This will enable detection of the forms or envelopes of stored words, according to syllabit sequences, and will reduce identification of specific words more closely to depend upon the skeletal or minimal phonemes that characterize each stored word. Consequently, the input synchronizer 32 provides a further procedure whereby the ambiguous, or simply categorical, identification processes (00, 54, 48, 44) are enlisted, and these indications are permitted to show F, N,V and S shapes in lieu of clear identification of (for example) phoneme identification outputs 33, 51, 05 and 45.

The first procedure for deriving the outputs F, N, V, S (via digital encoder circuits 174–177) is characterized as a "mode 1" procedure, whereas the further procedure of producing augments V, N, S, F (via connection network 180 and delay circuit 181) is characterized as a "mode 2" procedure. In one embodiment, the "mode 1" or "mode 2" procedures are optionally selected by the operator, using conventional operator selection means. However, in a further embodiment, automatic selection (on enablement) of the respective procedures can be performed under automatic control.

Figure 6A:
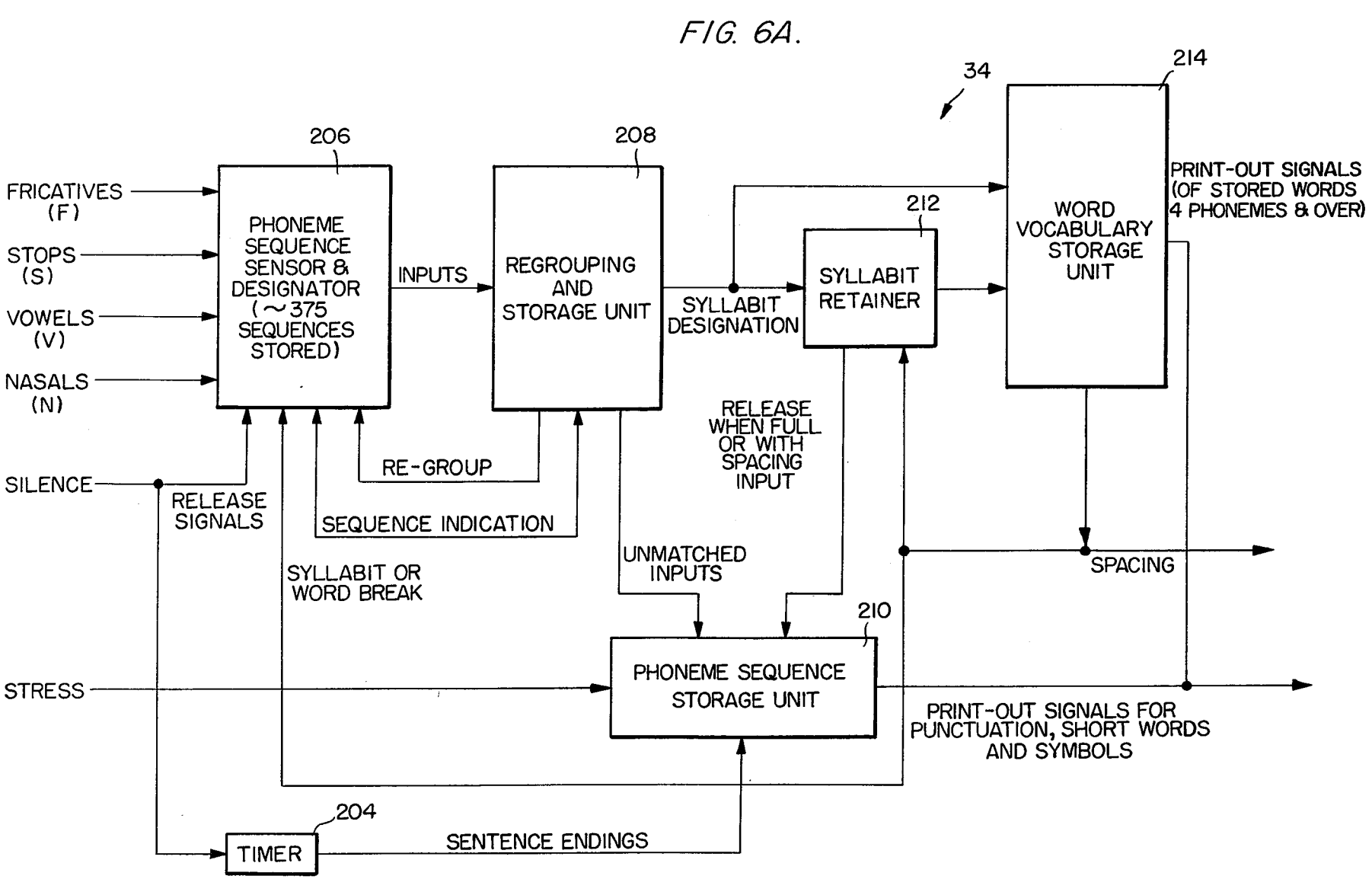
FIG. 6A is a detailed diagram of the functional elements of the transcriber processor of FIG. 1.
Figure 6B:
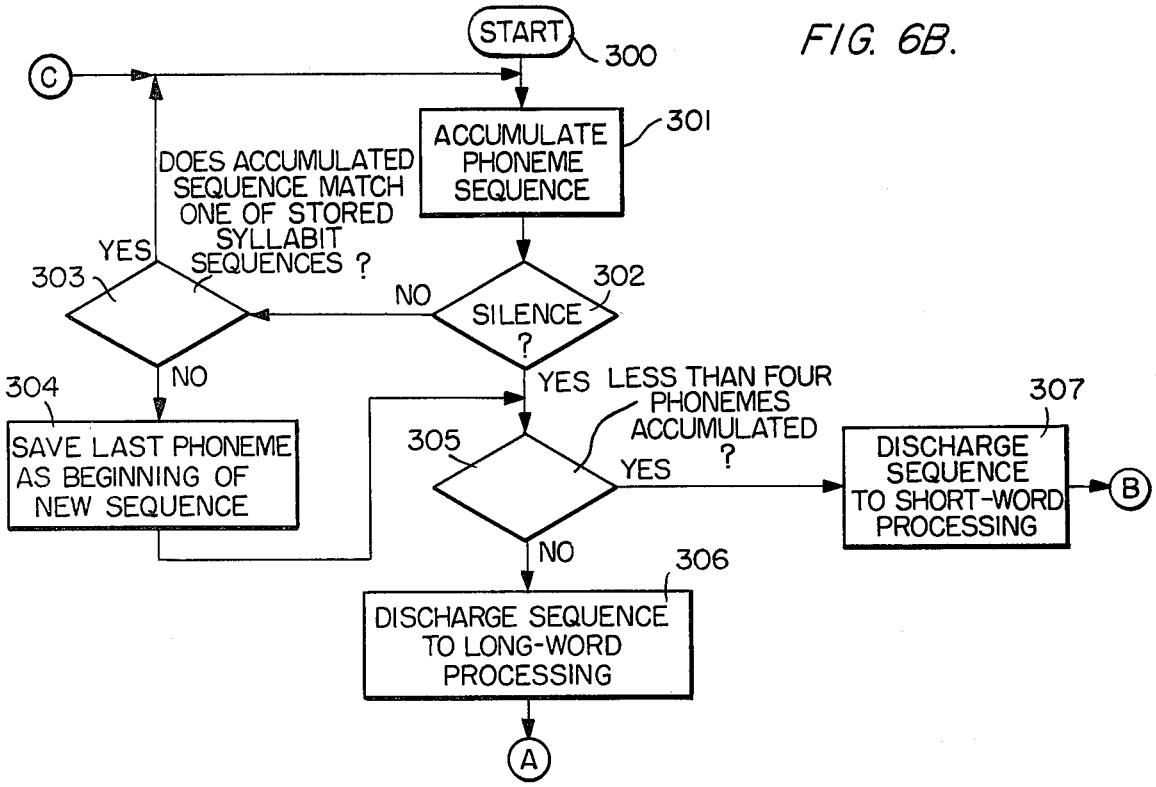
FIGS. 6B–6H are flowcharts of the operations performed by the transcriber processor of FIG. 1.

FIG. 6A is a detailed diagram of the functional elements of the transcriber processor 34, while FIG. 6B is a flowchart of the operations performed by transcriber processor 34 of FIG. 6A, since transcriber processor 34 is, in the preferred embodiment, implemented by a digital computer. As seen therein, the transcriber processor 34 comprises a phoneme sequence sensor and designator 206, a regrouping and storage section 208, a phoneme sequence storage unit 210, a syllabit retainer 212, and a word vocabulary storage unit 214.

To review the basic principles of the present invention, the invention is based on a two-tier approach. The first tier involves a set of operations based upon preliminary separation of sounds into nasals, stops, vowels and fricatives. The present inventor has discovered that 377 syllabits define all possible sequences of the four classes (nasals, stops, vowels and fricatives) of English speech. A basic ground rule has been utilized in developing the present invention, that being that every sequence of the four classes of sound must end either upon the appearance of the next vowel or upon the detection of silence. Based on this ground rule, the inventor has developed 3,000 entities which are stored in a memory associated with a processor (the latter memory and processor being contained within the transcriber processor block 34 of FIG. 1).

To further discuss the two-tier approach of the present invention, the first tier breaks down the spoken sequence of sounds into syllabits (that is, particular sequences of classes of sounds), separates the spoken sequence of sounds into possible words, and indicates how the spoken sounds are grouped. The second tier breaks the words down into sequences of only those phonemes which are indispensable to the identity of the word, and then "pins down" the specific word by use of the following procedures: (1) examine last phoneme; (2) compare it with words uncovered in the first tier, and exclude those whose last phoneme is different; (3) overlay the input (that is, the phoneme sequence input) onto a skeleton phoneme sequence for each of the remaining words; and (4) when all the elements of one of the skeletal phoneme sequences are included in the phoneme sequence input, and are present in the correct order, it is determined that a match exists, and the spoken word has been determined. Preferably, step (4) is performed by means of reverse matching, that is, matching the elements of the phoneme sequence input and the skeleton phoneme sequence element-by-element from the end of the sequence of elements to the beginning of the sequence of elements.

Further referring to FIG. 6A, as well as the flowcharts of FIGS. 6B–6H, as phoneme signals appear, they are passed to phoneme sequencer and designator 206, in which approximately 375 sequences are stored. The latter arrangement has the capacity to accumulate phonemes for 2.5 seconds, thus accumulating a maximum of approximately 18 phonemes in the process.

The phoneme sequencer and designator 206 also receives a signal SILENCE, also provided to timer 204. A further input signal BREAK, indicating a syllabit or word break, is received from the vocabulary storage unit 214. Initial sequence accumulation in the sensor and designator 206 does not cancel any input. Even inputs which are discharged (under guidelines set forth below) are processed in one way or another.

As indicated in the flowchart of FIG. 6B, the procedure commences by resetting and accumulating a new phoneme sequence, and determining whether or not a silence follows (blocks 301 and 302). If a silence does not exist, a determination as to whether or not the accumulated phoneme sequence matches one of the stored syllabit sequences is made (block 303). If a match does occur, reset and accumulation of a new phoneme sequence takes place (block 301). Conversely, if a match does not occur, further accumulation of the phoneme sequence is terminated, the last phoneme received is saved as the beginning of a new sequence (block 304), and the accumulated phoneme sequence (less this lasst phoneme) is discharged for further processing (blocks 305–307).

If, during accumulation of a phoneme sequence, silence is detected, a determination as to whether or not there are less than four phonemes accumulated is made (block 305). In addition, in the situation just described in the preceding paragraph (where a mismatch occurs, and the last phoneme is saved as the beginning of a new sequence), the determination as to whether or not less than four phonemes have been accumulated is also made.

If less than four phonemes are accumulated, the phoneme sequence is discharged for short-word processing (block 307). Conversely, if four or more phonemes have been accumulated, the sequence is discharged for long-word processing (block 306).

Referring to FIG. 6A, a regrouping and storage unit 208 is utilized to store syllabit patterns (viable input accumulations). About 3,000 patterns are stored in all, of which 377 are coded by numbers plus connecting vowels. The inventor has determined that there are 72 possible initial sequences up to the next occurrence of a vowel. Beyond initial sequences, there are 320 distinctive sequences (syllabits) that start with one to six consecutive vowels. The syllabits that can follow each other in the stored vocabulary extend to five patterns, at most. One-hundred eighteen syllabits can follow initials in the second position. Of those 118 syllabits, 55 can be in the third position, 65 can be in the fourth position, and only 20 can be in the fifth position.

Figure 6D:
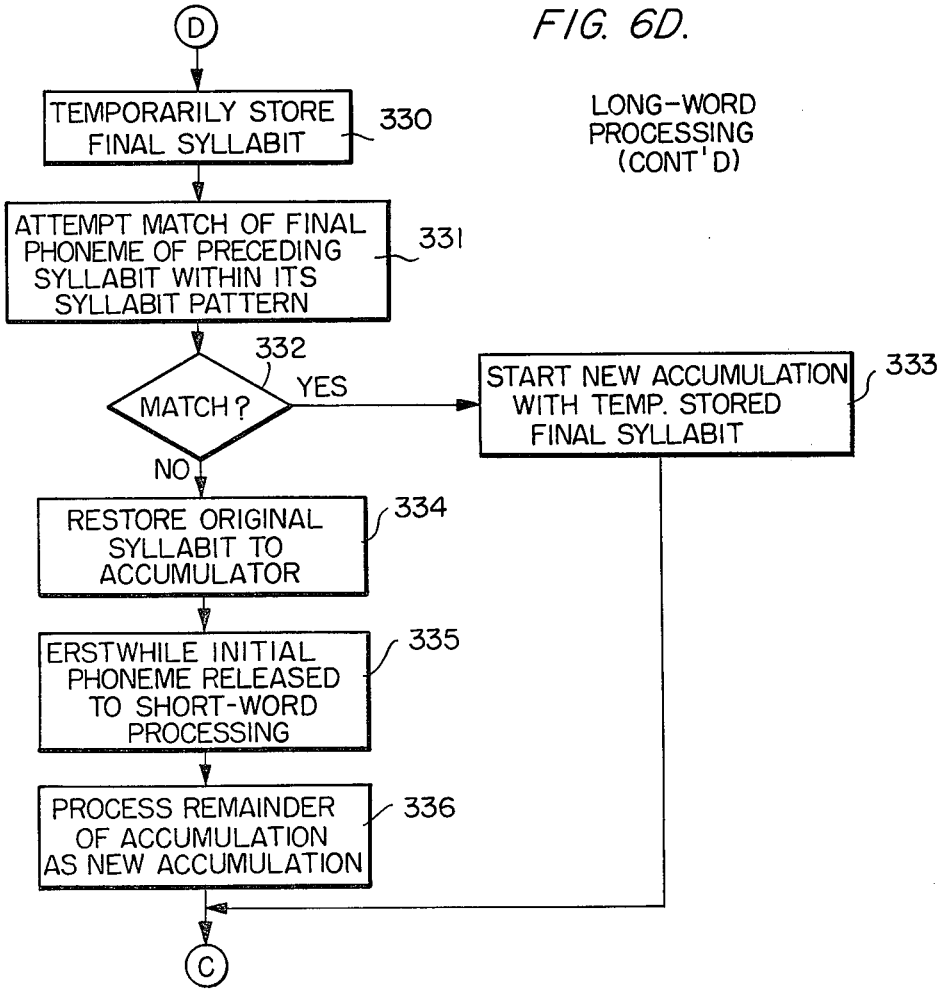
Figure 6C:
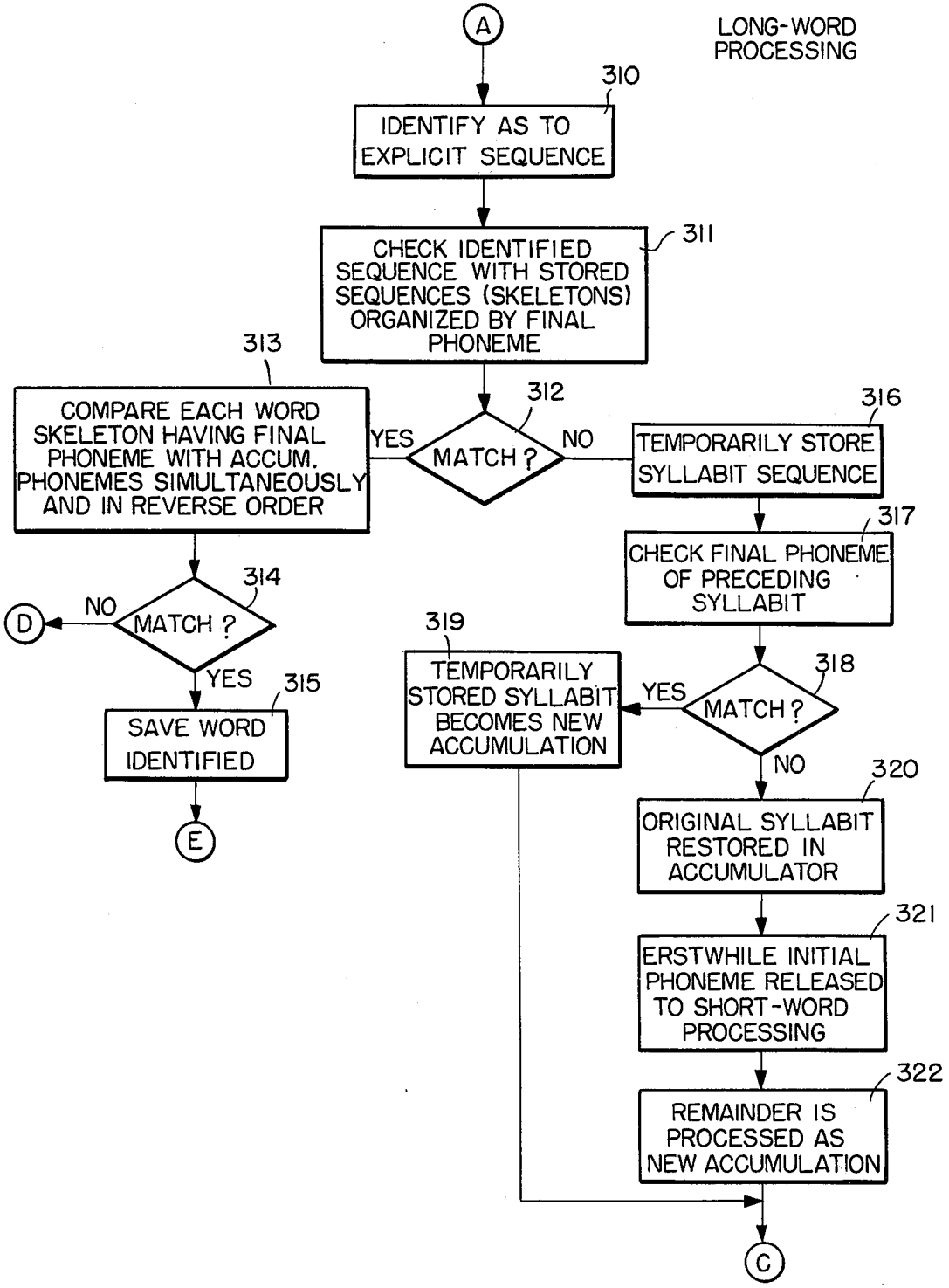
Figure 6E:
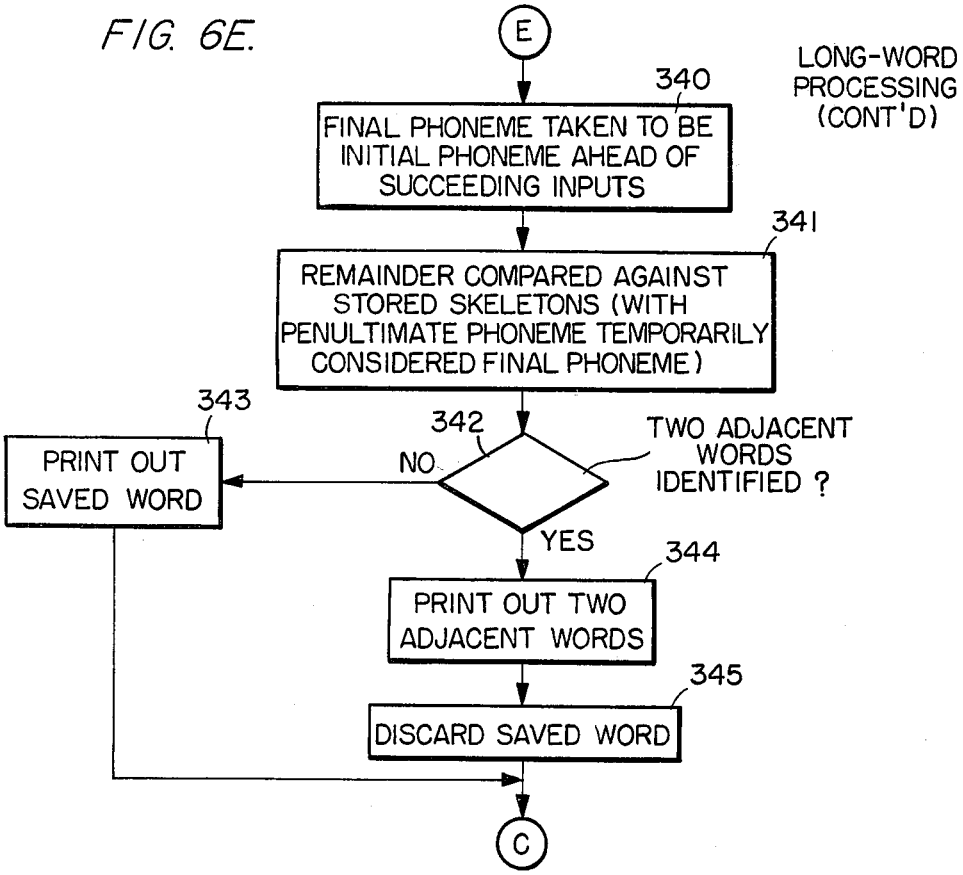

The long-word processing operation is now described, with reference to the flowcharts in FIGS. 6C–6E. Referring to FIG. 6C, an accumulated sequence of syllabits is identified as to its explicit sequence of classes of speech phonemes, and is then checked against storage of skeletons organized by final phoneme (blocks 310 and 311). Phoneme skeletons for all stored words are filed under the identity of the final phoneme of each word-shape in reverse order, and each skeleton is linked to a print-out command pattern, stored in the vocabulary storage unit 214 (FIG. 6A).

Continuing with the flowchart of FIG. 6C, if a match occurs between the identified sequence and one of the stored skeletons, each word skeleton is compared according to final phoneme with accumulated phonemes simultaneously and in reverse order (blocks 312 and 313). If a match occurs, the operations of FIG. 6E take place, by means of which the final phoneme is taken to be the initial phoneme ahead of succeeding inputs, and the remainder of the sequence (less the final phoneme) is compared against stored skeleton, with the penultimate phoneme temporarily considered the final phoneme (blocks 340 and 341). A determination is then made as to whether or not two adjacent words are identified (block 342). If two adjacent words are identified, the two adjacent words are printed out, and the saved word is discarded (blocks 344 and 345). Conversely, if two adjacent words are not identified, the saved word is printed out (block 343). The procedure then returns to the operations shown in FIG. 6B.

Returning to FIG. 6C, if, upon comparison of each word skeleton according to final phoneme with accumulated phonemes simultaneously and in reverse order (blocks 313 and 314), a match is not produced, the operations of FIG. 6D are carried out. That is to say, the final syllabit is temporarily stored, and a match of the final phoneme of the preceding syllabit within its syllabit pattern is attempted (blocks 330 and 331). If a match occurs, a new accumulation is started with the temporarily stored final syllabit, and a return to the operations of FIG. 6B is executed (blocks 332 and 333). Conversely, if a match does not occur, the original syllabit is restored to the accumulator, the erstwhile initial phoneme is released for short-word processing (to be discussed below), the remainder of the accumulation is processed as a new accumulation, and a return to the operations of FIG. 6B is executed (blocks 334–336).

Returning to FIG. 6C, if, upon checking the identified sequence with the stored skeletons organized by final phoneme, no match occurs (blocks 311 and 312), the syllabit sequence is temporarily stored, and the final phoneme of the preceding syllabit is checked (blocks 316 and 317). If, upon making this check, a match occurs, the temporarily stored syllabit becomes the new accumulation, and a return to the operations of FIG. 6B is executed (blocks 318 and 319). Conversely, if a match does not occur, the original syllabit is restored in the accumulator, the erstwhile initial phoneme is released for short-word processing, the remainder of the sequence is processed as a new accumulation, and a return to the operations of FIG. 6B is executed (blocks 320–322).

As an example of the above-described long-word processing operations, consider the following:

m s t I r i s=stored skeleton m I s t I r i As=input phonemes

It can be seen that, as a result of the long-word processing operations, the elements contained in the stored skeleton are all present in the input phoneme in correct order. Accordingly, the stored skeleton identified above will receive a positive match, and the stored vocabulary word corresponding to the stored skeleton will be printed out. In a preferred embodiment, the vocabulary storage unit 214 stores a minimum of about 10,000 spellings of longer words and 1,600 words having less than four phonemes.

Figure 6G:
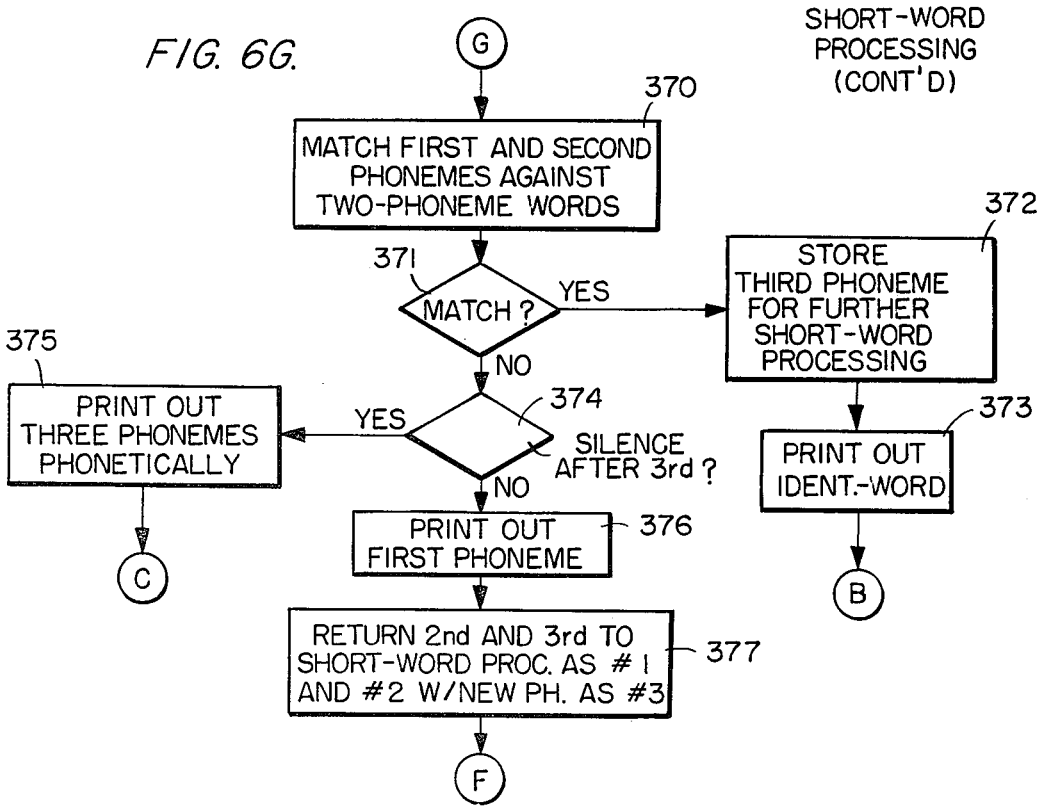
Figure 6F:
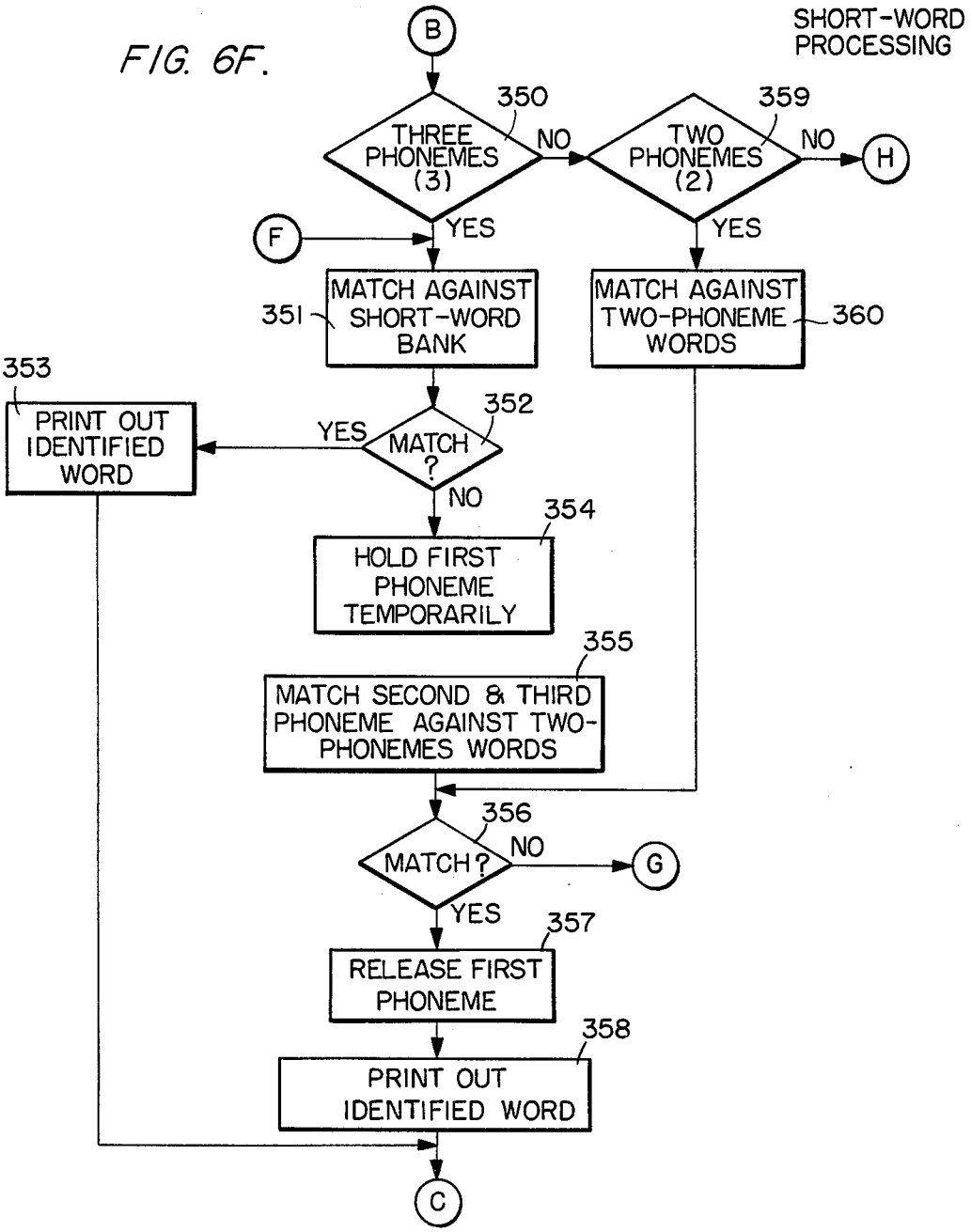

Referring to FIGS. 6F and 6G, short-word processing takes place as follows. Referring to FIG. 6B, upon determination that there are less than four phonemes accumulated (block 305), the sequence in question is discharged for short-word processing. Referring to FIG. 6F, a determination is made as to whether or not there are three or two phonemes, and thus, by a process of elimination, whether or not there is a single phoneme (blocks 350 and 359).

If there are three phonemes, the sequence is matched against a short-word bank within phoneme sequence and storage unit 210 (FIG. 6A). If a match occurs, the word identity is printed out, and a return to the operations of FIG. 6B is executed (blocks 351–353). If no match occurs, the first phoneme is temporarily held, and the second and third phonemes are matched against a two-phoneme word bank (blocks 354 and 355). If a match occurs, the first phoneme is released, the word identified by the second and third phonemes is printed out, and a return to the operations of FIG. 6B is executed (blocks 356–358).

Conversely, referring to FIG. 6G, if there is no match between the second and third phonemes and the words in the two-phoneme word bank, the first and second phonemes are matched against the two-phoneme words (block 370). If a match occurs, the third phoneme is stored for further short-word processing, and the word identified by the first and second phonemes is printed out (blocks 371–373). Operations then return to the top of FIG. 6F (block 350), so that short-word processing of the third phoneme may be carried out.

Returning to FIG. 6G, if upon matching the first and second phonemes against the two-phoneme words, a mismatch occurs, a determination as to whether or not there is silence after the third phoneme is made (block 374). If there is silence, the three phonemes are printed out phonetically (block 375). Conversely, if there is no silence, the first phoneme is printed out phonetically, and the second and third phonemes are restored as first and second phonemes of a new sequence, with a new third phoneme being added (blocks 376 and 377), and a return to the operations of FIG. 6F (block 351) is executed. That is, a new three-phoneme sequence is subjected to short-word processing.

Returning to the top of FIG. 6F, if less than three phonemes are present, a determination as to whether or not there are two phonemes is made (block 359). If there are two phonemes, a match against two-phoneme words in phoneme sequence and storage unit 210 is executed (block 360), and a branch to the operations of blocks 356 ff. is implemented.

Figure 6H:
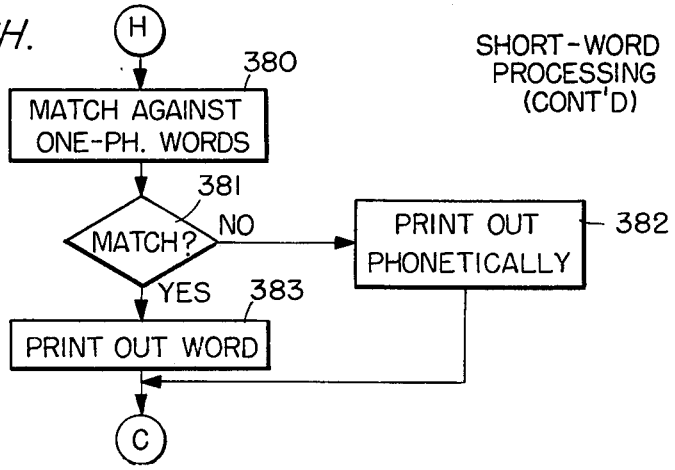

Finally, if only one phoneme is detected (decision block 359 produces a "no"), the operations of FIG. 6H are implemented, and the detected phoneme is matched against one-phoneme words (block 380). If there is a match, the identified word is printed out (blocks 381 and 383). If there is no match, the phoneme is printed out phonetically (block 382). In either case, a return to the operations of block 301 (FIG. 6B) is implemented.

Returning to FIG. 6A, it is seen that the signal SILENCE is applied to a timer 204. Upon detection of a predetermined time of SILENCE, as detected by timer 204, an output SE (sentence endings) is provided to the phoneme sequence and storage unit 210, so as to cause the unit 210 to provide a period at the end of the sentence.

Finally, only when there is a phonetic or other print out being provided by the phoneme sequence and storage unit 210 (in the case of short-word accumulation), does the positive-negative indication of stress, via input STRESS, become a factor. In fact, it affects the choice of print-out command.

The input signal STRESS is provided from the audio input, and is intended to enable the printer or display device to print or display upper-case letters instead of lower-case letters when phonetic transcriptions rather than stored words appear in the print-out or display, with the device responding to vocal stress above an adjustable threshold level when spoken loudly. This feature applies mainly to individual phonemes, and more to vowels than any other kind of speech element. It is analogous to pressing down the "shift key" of a typewriter as a response to loudness, but only at times when short-word outputs are being presented. Further eloboration on this feature can be found in U.S. Pat. No. 3,646,576, with specific reference to the sound separator disclosed in FIG. 2 thereof.

While preferred forms and arrangements have been shown in illustrating the invention, it is to be clearly understood that various changes in detail and arrangement may be made without departing from the spirit and scope of this disclosure. For example, whereas the above-described arrangement is shown as implemented in combined analog-digital circuitry, the invention is not limited to that implementation, and encompasses a totally digital implementation as well, the invention being limited only by the appended claims.

What is claimed is:

1. A two-tier method of converting an audio input, comprising words maade up of various sounds in a spoken sequence, into a visible form, comprising a sequence of corresponding phonemes, said method comprising the steps of:

(a) breaking down the spoken sequence of sounds into syllabits, each syllabit comprising a group of classes of sounds;

(b) grouping the syllabits into syllabit groups, each syllabit group defining corresponding possible words;

(c) providing, for each of said possible words corresponding to each syllabit group, a respective skeletal sequence of phonemes comprising a corresponding grouping of phonemes;

(d) determining, for each distinctive syllabit group, the phonemes occurring therein so as to develop an input sequence of phonemes for each syllabit group;

(e) comparing the input sequence of phonemes for each syllabit group with the respective skeletal sequence of phonemes of each of the corresponding possible words so as to determine, with reference to the phonemes in each grouping of phonemes, which possible word has a skeletal sequence of phonemes which contains, in a given sequence, phonemes all of which are found, in said given sequence, in the input sequence of phonemes, thereby identifying each of said words of said audio input; and (f) providing said identified words of said audio input in said visible form.

2. The method of claim 1, wherein step (e) comprises organizing said skeletal sequences of phonemes by final phoneme, determining whether there is a match between a final phoneme of said grouping of phonemes and said final phoneme of any of said skeletal sequences of phonemes, and comparing each said skeletal sequence of phonemes having a matching said phoneme with said grouping of phonemes.

3. The method of claim 1, further comprising the additional step, between steps (a) and (b), of determining whether or not a predetermined period of silence occurs after a given input sequence, and, if silence does occur, defining a word comprising at least one syllabit.

4. The method of claim 3, further comprising the additional steps of determining whether or not said defined word comprises more than a predetermined number of phonemes, and, if said defined word comprises more than a predetermined number of phonemes, further processing the defined word as a long word, and, if said defined word does not comprise more than a predetermined number of phonemes, further processing said defined word as a short word.

5. A two-tier system for converting an audio input, comprising words made up of various sounds in a spoken sequence, into a visible form, comprising a sequence of corresponding phonemes, said system comprising:

first means for breaking down the spoken sequence of sounds into syllabits, each syllabit comprising a group of classes of sounds;

second means for grouping the syllabits into syllabit groups, each syllabit group defining corresponding possible words;

third means for providing, for each of said possible words corresponding to each syllabit group, a respective skeletal sequence of phonemes comprising a corresponding grouping of phonemes;

fourth means for determining, for each distinctive syllabit group, the phonemes occurring therein so as to develop an input sequence of phonemes for each syllabit group;

fifth means for comparing the input sequence of phonemes for each syllabit group with the respective skeletal sequences of phonemes of each of the corresponding possible words so as to determine, with reference to the phonemes in each grouping of phonemes, which possible word has a skeletal sequence of phonemes which contains, in a given sequence, phonemes all of which are found, in said given sequence, in the input sequence of phonemes, thereby identifying each of said words of said audio input; and sixth means for providing said identified words of said audio input in said visible form.

6. The system of claim 5, wherein said first means comprises at least one transducer for receiving and processing said audio input, and issuing identification outputs, vowel identification circuitry for receiving and processing said audio input to determine which of said various sounds comprise vowels, and issuing corresponding vowel identification outputs, an input synchronizer for receiving and synchronizing said identification outputs of said at least one transducer and said vowel identification outputs of said vowel identification circuitry, and providing phoneme identification outputs, and a processor responsive to said phoneme identification outputs for breaking down the spoken sequence of sounds into syllabits.

7. The system of claim 6, wherein said vowel identification circuitry comprises a vowel scanner and a vowel transducer.

8. The system of claim 7, wherein said vowel scanner comprises a first formant peak detector for receiving and processing said audio input to detect a first formant peak in a first predetermined frequency range of said audio input, and a second formant peak detector for receiving and processing said audio input to detect a second formant peak in a second predetermined frequency range.

9. The system of claim 8, wherein said vowel scanner comprises at least one envelope detection and comparison network, each said at least one envelope detection and comparison network comprising a pair of envelope detectors for receiving and processing said audio input to determine amounts of energy stored in envelopes of said audio input in respective frequency ranges, and issuing corresponding detection outputs, and a comparator for comparing said corresponding detection outputs so as to selectively issue a corresponding vowel scanner output in correspondence thereto.

10. The system of claim 7, wherein said vowel transducer comprises at least one envelope detection network, each said at least one envelope detection network comprising a pair of envelope detectors for receiving and processing said audio input to determine respective quantities of energy stored in said audio input within respective predetermined frequency ranges, and issuing respective detector outputs, and a comparator for comparing said respective detector outputs so as to selectively issue corresponding comparison outputs.

11. The system of claim 10, wherein said vowel scanner issues vowel scanner outputs, said vowel transducer comprising gate means responsive to said comparison outputs and said vowel scanner outputs for issuing said vowel identification outputs.

12. The system of claim 6, further comprising a diphthong transducer connected to said vowel identification circuitry and receiving said vowel identification outputs therefrom, said diphthong transducer comprising an envelope detector for receiving and processing said audio input to determine the quantity of energy stored in an envelope in said audio input, and issuing a detector output, a comparator responsive to said detector output from said envelope detector and to said audio input for issuing a comparison output, and gate means responsive to said comparison output and to said vowel identification outputs of said vowel identification circuitry for selectively issuing diphthong identification outputs.

13. The system of claim 12, said diphthong transducer further comprising a ratio memory responsive to said comparison output for issuing a memory output corresponding to at least one predetermined ratio, and a further comparator responsive to said comparison output and to said memory output for issuing a further comparison output, said gate means being responsive to said further comparison output for selectively issuing said diphthong identification outputs.

14. The system of claim 6, wherein said input synchronizer comprises at least one sampler for receiving at least one of said phoneme identification outputs and said vowel identification outputs to provide sampler outputs, and at least one digital encoder for receiving and encoding said sampler outputs to provide encoder outputs corresponding to said at least one of said phoneme identification outputs and said vowel identification outputs.

15. In a system for converting an audio input, comprising words made up of various sounds in a spoken sequence, into a visible form, comprising a sequence of corresponding phonemes, said system comprising:

at least one transducer for receiving and processing said audio input to derive at least one phoneme identification output; and vowel identification means for receiving and processing said audio input to provide vowel identification outputs;

the improvement wherein said vowel identification means comprises a vowel scanner for scanning said audio input to obtain preliminary vowel identification outputs, and a vowel transducer for receiving and processing said audio input so as to provide an enabling signal selecting one of said preliminary vowel identification outputs, whereby to provide said vowel identification outputs of said vowel identification means.

16. In the system of claim 15, wherein said vowel scanner comprises formant peak detector means for detecting a pair of formant peaks in a respective pair of frequency ranges.

17. In the system of claim 15, further comprising diphthong transducer means connected to said vowel identification means for receiving said vowel identification outputs, and for receiving and processing said audio input in accordance with said vowel identification outputs, so as to provide final vowel identification outputs identifying specific vowels in said audio input, and diphthong identification outputs identifying specific diphthongs in said audio input.

18. In the system of claim 17, further comprising input synchronizer means connected to said at least one transducer and to said diphthong transducer means for receiving and synchronizing said phoneme identification outputs, said final vowel identification outputs and said diphthong identification outputs, so as to provide said sequence of corresponding phonemes comprising said visible form.

19. In the system of claim 18, further comprising processor means connected to said input synchronizer means and responsive to said sequence of corresponding phonemes for breaking down the sequence of corresponding phonemes into syllabits, each syllabit comprising a group of classes of sounds.

20. In the system of claim 19, wherein said processing means groups the syllabits into syllabit groups, each syllabit group defining corresponding possible words, and wherein said processor means provides, for each of said possible words corresponding to each syllabit group, a respective skeletal sequence of phonemes comprising a corresponding grouping of phonemes.

21. In the system of claim 20, wherein said processor means compares the input sequence of phonemes for each syllabit group with the respective skeletal sequences of phonemes of each of the corresponding possible words so as to determine, with reference to the phonemes in each grouping of phonemes, which possible word has a skeletal sequence of phonemes which contains, in a given sequence, phonemes all of which are found, in said given sequence, in the input sequence of phonemes, thereby identifying each of said words of said audio input, whereby to provide said identified words of said audio input in said visible form.

22. In the system of claim 15, further comprising input synchronizer means connected to said at least one transducer and to said vowel identification means for receiving and synchronizing said at least one phoneme identification output and said vowel identification outputs, respectively, so as to provide said sequence of corresponding phonemes comprising said visible form.

23. In the system of claim 22, further comprising processor means connected to said input synchronizer means for receiving and processing said sequence of corresponding phonemes so as to break down the spoken sequence of sounds into syllabits, each syllabit comprising a group of classes of sounds.

24. In the system of claim 23, wherein said processing means groups the syllabits into syllabit groups, each syllabit group defining corresponding possible words, and wherein said processor means provides, for each of said possible words corresponding to each syllabit group, a skeletal sequence of phonemes comprising a corresponding grouping of phonemes.

25. In the system of claim 24, wherein said processor means compares the input sequence of phonemes for each syllabit group with the respective skeletal sequences of phonemes of each of the corresponding possible words so as to determine, with reference to the phonemes in each grouping of phonemes, which possible word has a skeletal sequence of phonemes which contains, in a given sequence, phonemes all of which are found, in said given sequence, in the input sequence of phonemes, thereby identifying each of said words of said audio input, whereby to provide said identified words of said audio input in said visible form.

26. In a system for converting an audio input, comprising words made up of various sounds in a spoken sequence, into a visible form, comprising a sequence of corresponding phonemes, said system comprising:

phoneme identifying means responsive to said audio input for identifying said sequence of corresponding phonemes, and processor means for receiving and processing said sequence of corresponding phonemes to provide said identified words of said audio input in said visible form;

the improvement wherein said processor means breaks down the spoken sequence of sounds into syllabits, each syllabit comprising a group of classes of sounds, and wherein said processor means groups the syllabits into syllabit groups, each syllabit group defining corresponding possible words, and provides, for each of said possible words corresponding to each syllabit group, a respective skeletal sequence of phonemes comprising a corresponding grouping of phonemes.

27. In the system of claim 26, wherein said processor means compares the input sequence of phonemes for each syllabit group with the respective skeletal sequences of phonemes of each of the corresponding possible words so as to determine, with reference to the phonemes in each grouping of phonemes, which possible word has a skeletal sequence of phonemes which contains, in a given sequence, phonemes all of which are found, in said given sequence, in the input sequence of phonemes, thereby identifying each of said words of said audio input.

28. In the system of claim 16, wherein said vowel scanner further comprises envelope detector means for receiving and processing said audio input to determine amounts of energy stored in envelopes of said audio input in respective frequency ranges, and issuing corresponding detection outputs, and comparison means for comparing said corresponding detection outputs so as to selectively issue a corresponding vowel scanner output in correspondence thereto.

* * * * *